US006641000B2

(12) United States Patent
Lange

(10) Patent No.: US 6,641,000 B2
(45) Date of Patent: Nov. 4, 2003

(54) FUEL CONDUCTION SYSTEM

(76) Inventor: Jack Lange, 104 Old Mill Road, Winnipeg, Manitoba (CA), R3J 3G9

( * ) Notice: Subject to any disclaimer, the term of this patent is extended or adjusted under 35 U.S.C. 154(b) by 0 days.

(21) Appl. No.: 10/106,438

(22) Filed: Mar. 27, 2002

(65) Prior Publication Data

US 2002/0139438 A1 Oct. 3, 2002

Related U.S. Application Data

(60) Provisional application No. 60/278,701, filed on Mar. 27, 2001.

(51) Int. Cl.[7] ..... B65B 37/00

(52) U.S. Cl. ..... 222/318; 222/375; 222/608; 141/231; 141/285; 141/324; 141/382; 137/565.01

(58) Field of Search ..... 141/231, 285, 141/324, 382; 222/318, 372, 375, 380, 608; 137/565.01

(56) References Cited

U.S. PATENT DOCUMENTS

| | | | | | |
|---|---|---|---|---|---|
| 2,922,469 | A | * | 1/1960 | Rowe | 137/339 |
| 3,630,225 | A | | 12/1971 | Chitel | 137/565 |
| 3,877,458 | A | | 4/1975 | Allander | |
| 3,879,936 | A | * | 4/1975 | Stoltman | 60/39.281 |
| 3,969,608 | A | * | 7/1976 | Day | 392/478 |
| 4,345,694 | A | | 8/1982 | Chambers | |
| 4,351,301 | A | * | 9/1982 | Allen | 123/557 |
| 5,076,242 | A | * | 12/1991 | Parker | 123/514 |
| 5,233,963 | A | * | 8/1993 | Gregorius et al. | 123/456 |
| 5,303,842 | A | | 4/1994 | Harp et al. | |
| 5,515,891 | A | | 5/1996 | Langlois | |
| 5,720,325 | A | * | 2/1998 | Grantham | 141/59 |
| 6,296,480 | B1 | * | 10/2001 | Anderson et al. | 432/219 |

* cited by examiner

*Primary Examiner*—J Casimer Jacyna
(74) *Attorney, Agent, or Firm*—Ryan W. Dupuis; Adrian D. Battison; Michael R. William

(57) ABSTRACT

A fuel conduction system is provided for conducting fuel between a fuel source and a fuel consuming device which are either integrated as a single unit or apart as separate units. The system generally comprises concentric supply and return tubes for connection between the fuel source and the pump of a consuming device. A valve is positioned in series with the supply line which prevents siphoning of the contents of the supply line if it is damaged. Anti-siphoning and flashback arrest measures are also provided on the return line. In one embodiment, the fuel conduction system may be used on a portable fuel storage devices for refueling various consuming devices. In another embodiment, the fuel conduction system may be used on a fuel consuming device, between the pump and fuel storage container thereon, so that the fuel storage container may be selectively separated from the device in a safe manner.

23 Claims, 2 Drawing Sheets

FUEL CONDUCTION SYSTEM

This application claims the benefit of provisional application Ser. No. 60/278,701 filed Mar. 27, 2001.

FIELD OF THE INVENTION

The present invention relates to a fuel conduction system for conducting fuel between a fuel source and a fuel consuming device which are either integrated as a single unit or apart as separate units. More particularly, the invention relates to a fuel conduction system arranged to prevent siphoning of the fuel in the event of a fuel line failure as well as inhibiting the occurrence of flash-back at the fuel source.

BACKGROUND

Portable fuel consuming equipment including portable heaters and engine driven generator sets are known equipment which are widely used, for example in the field of construction and the like. In such equipment, fuel is required to be pumped through flexible fuel lines between a fuel source and a pump of the equipment. These lines include a pump supply line and a pump pressure regulation bypass return line which typically run along the floor.

Damage to these lines, for example due to piercing of the line or fire, can result in numerous undesirable situations including siphoning or pumping of the contents of the fuel source onto the floor or flash-back through the lines back to the fuel source. Numerous requirements, both regulatory as well as user or site imposed requirements, are thus commonly required to be met when using portable fuel consuming equipment in order to satisfy either safety concerns, environmental concerns or individual concerns relating to a particular use of the equipment.

Describing the equipment now in further detail, fuel consuming equipment which is intended for temporary use generally incorporates an integral fuel tank which is factory assembled to a platform, frame or body of these devices. The weight of stored fuel however can be quite substantial and added to the weight of the fuel consuming equipment is often a major impediment to portability. Portability is a major attribute of the functionality of such equipment which frequently must be moved and handled involving such operations as loading and unloading from trucks and being moved about on temporary sites often over soft, uneven or obstacled ground.

In the case of lighter equipment such as portable heaters, the moving and handling of the equipment can be much ameliorated if the fuel is supplied from fuel storage containers which are separate from the fuel consuming equipment so that the equipment and fuel storage container can be independently handled on and off the temporary sites. Fuel lines may thus be required to extend between the fuel source and the fuel consuming equipment over a considerable distance over which the fuel lines are susceptible to one of many possible forms of damage possibly resulting in siphoning of the fuel or a flashback situation.

In the case of heavier equipment including diesel driven generator sets and pumps, portability is dealt with by assembly of these devices complete with a separate fuel storage container onto a common platform such as a skid which facilitates movement about on temporary sites. This arrangement similarly requires fuel lines to extend between the fuel source and the fuel consuming equipment with the lines again being susceptible to one of many possible forms of damage possibly resulting in siphoning of the fuel or a flashback situation. The fuel lines in this instance are required to meet any factory built equipment requirements.

The above mentioned approaches to conducting fuel between a fuel storage container and a fuel consuming device however affect concerns with regard to safety and environment and change the category into which the equipment falls with regard to regulatory enforcement that applies.

The options of supplying fuel containers either integrally or remotely with respect to fuel consuming devices and supplying repair and maintenance shop assemblies complete with separate fuel containers into the field causes the equipment to fall, from a regulation standpoint, into the category of a field installation as opposed to factory assembled packaging. Safety requirements that apply to fuel storage and fuel lines with factory assembled equipment, as opposed to field installations, while similar in their general intent to prevent fuel escape, differ significantly in practical details as to how compliance can be achieved.

Furthermore, equipment with either integral or remote fuel containers and maintenance shop assemblies complete with separate fuel containers fall into the subcategory of temporary field installations, including repair and maintenance shop assemblies transported on and off temporary sites, as opposed to permanent field installations. The same environment and safety regulations that apply to permanent use field installations of fuel consuming devices also apply to temporary use field installations. Regulations that apply to stationary, permanent use equipment however, are often not entirely appropriate to the circumstances that apply to portable, temporary use equipment.

It is readily recognisable that such requirements for permanent field installations could impose relatively time consuming and expensive installations in relation to short term equipment requirements. Furthermore the installations which meet permanent use requirements interfere with operational flexibility on temporary sites and may be sensitive to temporary use conditions such as exposure to extreme temperatures, weather conditions and handling problems due to freighting from site to site.

It is a broad requirement of all of the various sets of regulations that a fuel system not permit fuel in storage containers to escape should a fuel line failure occur. Enforcement with respect to factory assembled packages has always been strict through equipment certification procedures but enforcement in temporary situations until recently has been tenuous. Recent concerns about environmental issues have brought about tighter enforcement.

In addition to requirements regarding siphoning, due to the possibility of flash-back, a further requirement which can apply to particular applications of fuel consuming equipment is the incorporation of a flash-back arrestor. In the event of a fuel line burn through, for example due to a floor fire, combustion in the form of a flash-back has the potential to spread through fuel residue and vapour remaining in the supply line to the fuel source unless a flash-back arrestor is in place. Portable fuel consuming equipment having supply and return lines extending between a pump and a fuel source can thus be easily susceptible to flashback arising from floor fires and the like when no arrestor is provided.

An example of portable fuel consuming equipment is illustrated in U.S. Pat. No. 3,630,225 to Chitel. A portable heating system is described which makes use of a remote fuel tank by extending a supply line and a return line between the fuel tank and a pump mounted integrally on a heater unit in a common configuration. An anti-siphon valve is mounted on the supply line adjacent the fuel tank to prevent siphoning of the contents of the fuel tank through the supply line in the event of a line failure. The arrangement of Chitel however, similarly to conventional configurations commonly employed, does not meet basic requirements imposed on such equipment due to an exposed return line which could either partially siphon the contents of the fuel tank therethrough in the event of a line failure, or could result in fuel being pumped through the return line onto the floor if only the return line were damaged. Furthermore, Chitel provides no protection against possible flash-back.

SUMMARY

According to one aspect of the present invention there is provided a fuel conduction system for conducting fuel between a fuel source and a pump having an inlet, a main outlet and a pressure regulation return outlet, the fuel conduction system comprising:

a supply line extending in a longitudinal direction from a pump connecting end arranged to be connected to the inlet of the pump to a source connecting end arranged to be connected to the fuel source; and a return line extending substantially concentrically through the supply line in the longitudinal direction of the supply line from a pump connecting end adjacent the pump connecting end of the supply line and arranged to be connected to the pressure regulation return outlet to a source connecting end adjacent the source connecting end of the supply line arranged to be connected to the fuel source.

With the return line arranged to extend concentrically through the supply line, the only manner in which the return line can leak fuel into the surrounding environment is if the supply line surrounding the return line is also pierced, thus effectively cutting off the supply of fuel to the pump to prevent fuel from being continuously pumped out during a line failure. The use of the fuel conduction system as described above thus permits requirements to be met regardless of whether the fuel source is mounted integrally or apart from the fuel consuming device.

An automatic shut-off valve is preferably coupled in series with the supply line adjacent the source connecting end which includes a valve member biased towards a closed position. The valve member is arranged to be opened in response to a reduction in pressure in the supply line associated with activation of the pump. The incorporation of a valve in the supply line further ensures that fuel is not spilled from the fuel storage container by siphoning through the supply line. The valve also effectively acts as a flashback arrestor for meeting both safety and environmental requirements, regulatory or otherwise, relating to both flashback and siphoning in a fuel conduction system.

The valve may be arranged to extend upwardly from an inlet to an outlet with the valve member being weighted so as to be seated on the inlet in the closed position in response to a reduction in pressure in the supply line associated with siphoning action of the supply line while being arranged to be raised upwardly from the inlet in an open position in response to a reduction in pressure in the supply line associated with activation of the pump.

A tank fitting may be provided which is arranged to selectively mount the source connecting ends of the respective supply and return lines to the fuel storage container. The tank fitting would preferably include the valve mounted integrally thereon.

There may be provided a flashback arrestor coupled in series with the return line adjacent the source connecting end thereof in addition to the valve on the supply line. The fuel conduction system is thus arranged to meet requirements regarding flashback protection.

In addition to the valve on the supply line, there may also be provided a vent coupled to the return line adjacent the source connecting end thereof. The vent would be arranged to permit air to be drawn into the return line so as to prevent siphoning of fuel from the fuel source through the return line in the event of line failure. The vent preferably comprises an air flow check valve being arranged to restrict passage of fuel from the return line through the check valve while permitting air to be drawn into the return line.

An outlet line is preferably arranged to be coupled between the main outlet of the pump and a fuel consuming device with an envelope being provided surrounding the outlet line between respective ends thereof. The envelope is preferably coupled in communication with the supply line so as to produce a reduction in pressure within the envelope surrounding the outlet line upon activation of the pump. The envelope and the outlet line may comprise respective elongate tube members with the outlet line extending substantially concentrically through the envelope.

A manual shut-off valve may be coupled in series with the supply line adjacent the source connecting end thereof.

For connection of the lines to the pump, a pump connector may be coupled to the respective pump connecting ends of the supply and return lines. The pump connector preferably includes a pump inlet line in communication with the pump connecting end of the supply line which is arranged to be selectively coupled to the inlet of the pump and a pump return outlet line in communication with the pump connecting end of the return line which is arranged to be selectively coupled to the pressure regulation return outlet of the pump.

For connection of the lines to the fuel source, a fuel source connector may be coupled to the respective source connecting ends of the supply and return lines. The fuel source connector preferably includes source outlet line in communication with the source connecting end of the supply line which is arranged to be selectively coupled to the fuel source and a source inlet line in communication with the source connecting end of the return line which is arranged to be selectively coupled to the fuel source.

According to a second aspect of the present invention there is provided a fuel conduction system in combination with a fuel consuming device, the system comprising;

a fuel source;

a pump having an inlet, a main outlet and a pressure regulation return outlet;

a supply line extending in a longitudinal direction from a source connecting end coupled to the fuel source to a pump connecting end coupled to the inlet of the pump;

a return line extending substantially concentrically through the supply line in the longitudinal direction of the supply line from a source connecting end coupled to the fuel source to a pump connecting end coupled to the pressure regulation return outlet of the pump; and an outlet line coupled between the main outlet of the pump and the fuel consuming device.

Whether the fuel source and the fuel consuming device are deployed integrated as a single unit or apart as separate units, when connected utilizing the fuel conduction system, the combination will prevent fuel leakage arising from fuel being pumped out due to a return line failure.

To further protect the fuel source from either draining, siphoning or pumping there may be provided an automatic shut-off valve coupled in series with the supply line adjacent the source connecting end including a valve member which is biased towards a closed position. The valve member is preferably arranged to be opened in response to a reduction in pressure in the supply line associated with activation of the pump.

As noted above, the incorporation of a valve in the supply line further ensures that fuel is not spilled from the fuel storage container by siphoning through the supply line as well as effectively acting as a flashback arrestor. Safety and environment concerns as they apply to both field installation and the factory assembly of fuel storage and fuel consuming equipment may thus be satisfied.

Preferably the supply and return lines are selectively separable from both the fuel source and the pump so as to permit the fuel source to be readily disconnected from and connected to the pump.

There may be provided an envelope surrounding the outlet line between respective ends thereof. The envelope is preferably coupled in communication with the pump inlet so as to produce a reduction in pressure within the envelope surrounding the outlet line upon activation of the pump.

The fuel source preferably comprises a portable fuel container which is supported for rolling movement across the ground. The fuel consuming device may be arranged to be selectively supported on the fuel source so as to permit selective separation thereof. The pump may be mounted integrally on either the fuel consuming device or the fuel source in this instance.

According to a further aspect of the present invention there is provided a portable fuel source for supplying fuel to a fuel consuming device having a pump including an inlet, a main outlet and a pressure regulation return outlet, the portable fuel source comprising:

- a fuel storage container supported for rolling movement across the ground;
- a supply line arranged to be coupled between the container and the inlet of the pump;
- a return line arranged to be coupled between the container and the pressure regulation return outlet of the pump; and
- a valve mounted integrally on the container and being arranged to be coupled in series with the supply line, the valve including a valve member which is biased towards a closed position, the valve member being arranged to be opened in response to a reduction in pressure in the supply line associated with activation of the pump.

The return line extends substantially concentrically through the supply line between respective ends of the lines for additional protection fuel spillage from the container. A vent on the return line arranged to permit air to be drawn into the return line inhibits siphoning of fuel from the fuel source through the return line for protection against siphoning of the fuel container contents in additional to the valve on the supply line.

A flashback arrestor mounted integrally on the container and being arranged to be coupled in series with the return line in addition to the valve on the supply line ensures that the container is adequately protected against flashback.

BRIEF DESCRIPTION OF THE DRAWINGS

In the accompanying drawings, which illustrate an exemplary embodiment of the present invention.

DETAILED DESCRIPTION

Figures 1, 5:
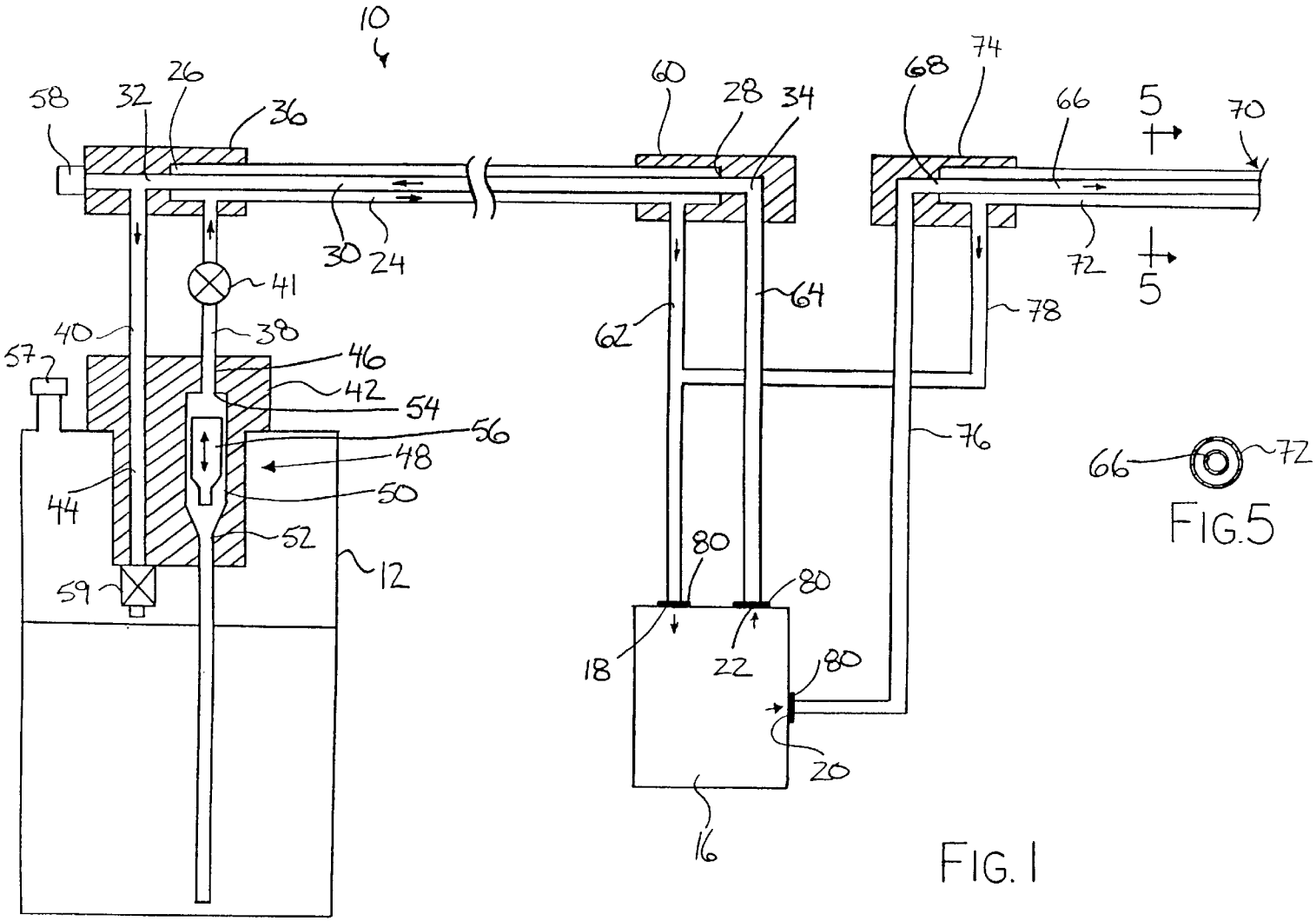
FIG. 1 is a schematic view of the fuel conduction system as it would be incorporated between a fuel source and the pump of a fuel consuming device.
FIG. 5 is a cross sectional view along the line 5—5 of FIG. 1.

Referring to the accompanying drawings, there is illustrated a fuel conduction system generally indicated by reference numeral 10. The fuel conduction system 10 is intended for use in conducting fuel from a fuel source 12 such as a fuel storage container to a fuel consuming device, for example a portable heater 14.

Although a portable heater 14 is illustrated in the drawings any fuel consuming device including generators, and other forms of diesel powered construction equipment and the like, may incorporate the fuel conduction system 10 for safely conducting fuel from a fuel source to the equipment.

The heater 14 includes a pump 16 supported thereon. The pump 16 includes an inlet 18, a main outlet 20 and a pressure regulation bypass return outlet 22.

A supply line 24 is provided in the form of an elongated flexible tube having a source connecting end 26 and a pump connecting end 28. The supply line is arranged to be connected between the fuel source 12 at the source connecting end 26 and the inlet 18 of the pump at the pump connecting end 28.

A return line 30 is also provided in the form of an elongate flexible tube which is arranged to extend through the supply line 24 concentrically therein in the longitudinal direction of the supply line 24. The return line 30 similarly extends between a source connecting end 32 and a pump connecting end 34.

A fuel source connector 36 is arranged to connect the respective source connecting ends of the supply line and return line to the fuel source 12. The fuel source connector 36 separates the supply line and the return line to permit them to be connected to the fuel source individually thus acting as a flow splitter. The fuel source connector includes a first port which connects the source connecting end 26 of the supply line to a source outlet line 38. The source outlet line 38 is in communication between the supply line 24 at the source connecting end 26 thereof and the fuel source 12. A second port in the fuel source connector 36 communicates between the source connecting end 32 of the return line and a source inlet line 40 in communication with the fuel source 12.

A manual shut-off valve 41 is mounted in series with the source outlet line 38 for selectively shutting off the supply of fuel to the pump as desired.

A tank mounting member 42 is provided for selectively coupling the source outlet line 38 and the source inlet line 40 to the fuel source 12. The tank mounting member 42 is a plug which selectively mounts through a top side of a fuel storage tank. The member 42 includes a return port 44 which receives the source inlet line 40 therethrough and a supply port 46 which receives the source outlet line 38 therethrough. The source outlet line 38 is arranged to extend beyond the tank mounting member 42 through to a bottom end of the fuel source as illustrated.

An automatic shut-off valve 48 is coupled in series with the source outlet line 38 and is mounted integrally within the supply port 46 of the tank mounting member 42. The valve 48 includes a valve chamber 50 which extends upwardly from an inlet 52 to an outlet 54 thereof. A weighted valve member 56 is movable within the valve chamber 50 between a closed position in which the valve member 56 is seated across the inlet 52 and an open position in which the valve member 56 is raised upwardly from the inlet 52 as illustrated in FIG. 1. The valve member 56 is arranged to be narrower in diameter than the valve chamber 50 so as to permit the flow of fuel therebetween when the valve member 56 is opened.

The valve member 56 is appropriately weighted so as to be normally biased towards the closed position until the pump is activated such that the reduction in pressure in the supply line is sufficient to lift the valve member from the inlet 52. The valve member 56 is also weighted such that the reduction in pressure in the supply line resulting from a siphoning action if the supply and return lines were severed is not sufficient to lift the valve member 56 thus ensuring that no fuel is siphoned from the fuel source through the supply line in the event of a line failure. The valve member thus acts to differentiate between the reduction in pressure in the supply line associated with a siphoning action or activation of the pump for selectively restricting flow of fuel in the same direction the fuel would normally be flowing during pump operation.

The fuel source 12, illustrated as a storage container in FIG. 1, includes an opening 57 in a top side thereof. The opening 57 is a conventional opening for filling or dispensing fuel therethrough which includes a cover mounted thereon in sealing engagement about the opening.

An air flow check valve 58 is mounted integrally on the fuel source connector 36 and communicates with the source end 26 of the supply line 24 through a port in the connector 36. The check valve 58 is arranged to restrict fuel from leaking out into the surrounding environment while permitting air to be drawn in therethrough in the event of a siphoning action which may result due to a line failure. In normal operation pressurized fuel is pumped through the return line past the check valve 58 and back into the fuel source 12 with the check valve 58 in a closed position. In the event of a line failure in which the return line is severed at a point along the floor, the fuel contents of the return line will begin to dump onto the floor in a siphoning action which causes the check valve 58 to be opened for drawing air into the return line, thus preventing any siphoning of the fuel from the fuel source 12. In this arrangement if both the supply and return lines 24 and 30 were completely severed the automatic shut-off valve 48 would prevent siphoning of the fuel source contents through the supply line while the check valve 58 prevents siphoning through the return line 30.

A flash-back arrestor 59 is mounted integrally on the tank mounting member 42 at the return port 44 in series with the return line. The flash-back arrestor 59 is a metal filter which is arranged to extinguish flash-back combustion by heat absorption to inhibit flash-back into the fuel source through the return line. The arrestor 59 complements the automatic shut-off valve 48 in protecting the fuel source from flash-back combustion. The automatic shut-off valve 48 also acts as a flash-back arrestor coupled in series with the supply line as the valve member 56 is arranged to be seated in a closed position in the event the supply line was severed due to fire or other. In order that the fuel air mix in the lines be appropriate to support a flash-back condition, the lines would have to have been sufficiently severed from the pump, by fire or other, that the resultant loss of suction in the supply line would cause the automatic shut-off valve 48 to be closed well in advance of a flash-back condition causing a threat to the fuel source.

A pump connector 60 is mounted on the respective pump connecting ends of the supply and return lines for separating lines so that they be connected to the pump individually. The pump connector 60 thus acts as a flow splitter having a first port for communicating between the pump end 28 of the supply line and a pump inlet line 62 which is arranged to be coupled to the inlet 18 of the pump, and a second port which communicates between the pump communicating end 34 of the return line and a pump return outlet line 64 which is coupled to the pump return outlet 22.

An outlet line 66 is arranged to be coupled between the pump 16 and the heater 14. The outlet line 66 is an elongate flexible tube which extends between a pump end 68 and a heater end 70. An envelope 72 surrounds the outlet line 66 between respective ends thereof. The envelope 72 also comprises an elongate flexible tube member which receives the outlet line 66 concentrically therein so as to extend in the longitudinal direction of the envelope.

An outlet connector 74 is provided for separating the envelope 72 and the outlet line 66 adjacent the pump end 68 thereof for individual connection to the pump 16. The outlet connector includes a first port which communicates between the pump end 68 of the outlet line 66 and a main pump line 76 coupled to the main outlet 20 of the pump. The outlet connector 74 also includes a second port in communication between the envelope 72 and a suction line 78 which is coupled to the pump inlet 62. In this arrangement activation of the pump subjects the envelope 72 to the same pressure reduction as the supply line 24 to prevent leakage of fuel from the envelope due to slight line failure from cracks and the like for example in the envelope.

The connector lines 62, 64 and 76 are all coupled to the pump 16 using selective couplings 80 which permit the lines to be disconnected and reattached to the pump as desired. These connector lines are all very short so as to permit shielding thereof in an effective manner compliant with regulatory requirements. When supporting the pump 16 directly on the heater 14 as illustrated in FIGS. 2 through 4, the outlet line 66 is also very short and may be shielded similarly to the connector lines 62, 64 and 76 in place of the envelope 72.

The heater end 70 of the outlet line 66 is coupled directly to the heater 14 with the envelope 72 being capped adjacent the heater end 70.

Figure 2:
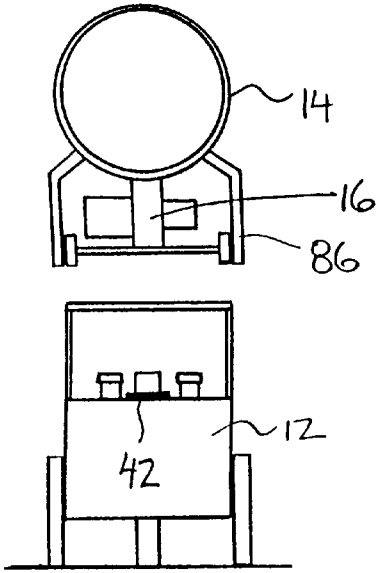
FIG. 2 is an end elevational view of a portable heater which may be separated from its fuel tank.
Figure 3:
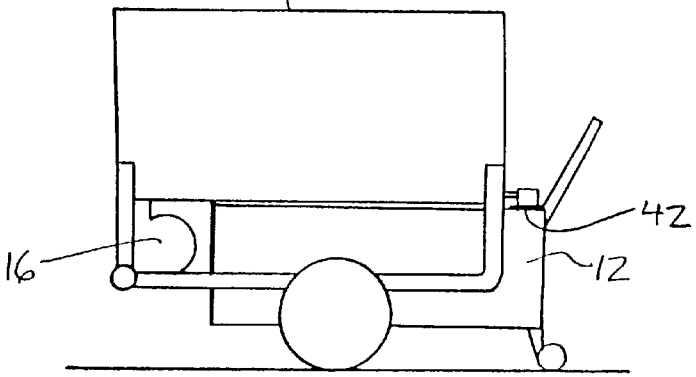
FIG. 3 is a side elevational view of the portable heater shown mounted on the fuel tank.
Figure 4:
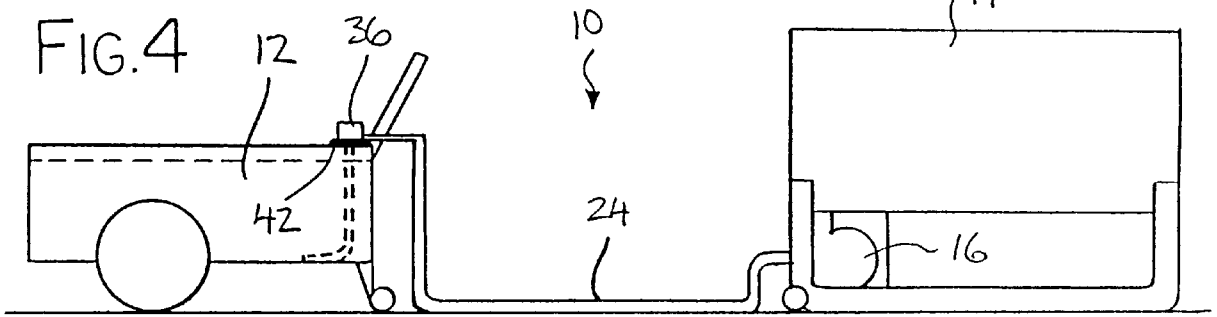
FIG. 4 is a side elevational view of the portable heater of FIGS. 2 and 3 in which the heater is shown separated from the fuel tank with the fuel conduction system coupled therebetween.

As illustrated in more detail in FIGS. 2 through 4, the fuel source 12 may comprise a tank which is arranged to be supported for rolling movement along the ground. The heater 14 is supported on a frame 86 which is selectively mountable on the fuel source 12 so as to form an integral unit as illustrated in FIG. 3. The frame 86 secures the heater 14 on the fuel source for rolling movement across the ground therewith.

Using the fuel conducting system 10, the heater 14 may be separated from the fuel source 12 while still meeting requirements, regulatory or otherwise, regardless of whether the heater is attached or separated from the fuel source. The selective couplings 80 on the pump as well as the selective mounting of the tank mounting member 42 permit either an integral tank or an external remote fuel source to be used in supplying fuel to the pump and heater 14.

When using a remote fuel source or a fuel source which can be selectively separated from the fuel consuming device as illustrated in FIG. 4, the fuel conducting system 10 ensures that fuel from the fuel source 12 will not be spilled out onto the floor in the event that either one or both of the supply and return lines are severed. The concentric arrangement of the lines provides that the positively pressurized return line is completely contained within the negatively pressurized supply line between respective ends of the line to adequately shield the return line from spilling out onto the floor.

If the outside wall of the concentric line set is opened through at any point, fuel cannot escape because of the negative pressure. The pump would then draw air in and in the case of more minor failure by an entraining air, contain the leak and likely occasion general shutdown through interfering with the proper operation of the fuel consuming device. In the case of more massive failure including the complete severance of both concentric lines, either an air lock occurs or both lines become physically detached from the fuel source and therefore cease to move fuel.

Although a portable construction heater is provided as an example, the fuel conduction system 10 is useful with any fuel storage container and devices that consume fuels such as portable generator sets, portable lighting plants and portable pumps. It may also be used in permanent applications in order to meet guidelines for fuel containment and conduction. Meeting these guidelines provides that the fuel conduction system 10 be arranged such that when fuel lines of a fuel system extend beyond the boundaries of an integral fuel containment of the fuel system, the fuel lines are arranged so that they do not drain, pump, siphon or otherwise allow fuel to be conveyed or escape from the fuel storage container of the fuel system in the event that the fuel lines are either damaged or severed.

The system 10 enables the fuel storage container to be readily mounted or dismounted by means of wheels, tracks, slides, locking hardware, fuel line disconnects, etc. to or from the frame, platform and/or body of the fuel consuming device. Both the fuel storage container and the fuel consuming device are preferably constructed in such a manner that they be joined together and transported to and from and deployed on the application site integrated as a unit or separated and transported to and from and deployed on the site as individual units. Once on site in either mode they can be made operational and compliant with environment and safety concerns by connecting them using the fuel conduction system 10 described herein.

The system is also useful in any application where any or all of the features of this system are desirable including but not limited to, the transfer of liquids of any type from one point to another wherever there is concern about leakage from lines, as exampled by the fuelling of aircraft from tanker trucks, the loading of liquid fertilizers, etc.

The fuel source 12, as illustrated in FIG. 4 as a tank supported on wheels for rolling movement across the ground, can also be used independently from the fuel consuming device as a portable fuel tank or fuel caddy for refilling tanks on various equipment or for supplying fuel to any one of numerous fuel consuming devices. The incorporation of the automatic shut-off valve 48 on the tank mounting member 42 which is mounted integrally on the tank in FIGS. 2 through 4, ensures that the tank is protected against both siphoning of the contents of the fuel source as well as being protected against flash-back. The air check valve 58 on the return line and a flash-back arrestor 59, in addition to the automatic shut-off valve 48 ensure that both the supply and return lines are fully protected from possible siphoning or flash-back so that the portable fuel tank can be used in various applications while still meeting the appropriate requirements for its use. When using the fuel source as a fuel caddy, it would be equipped with an electrical or hand-driven, reversible, transfer pump for both the fuelling and de-fuelling of small, integral fuel tank equipment.

The fuel conduction system 10 provides a fundamental safety benefit in that it prevents fuel in a storage vessel from escaping should the fuel lines running from it to the fuel consuming equipment be ruptured in any fashion. It accomplishes this in a simple unique fashion particularly suited to portable application. The ability to provide an anti-siphon configuration which is further protected from flashback is particularly desirable with portable equipment because fuelling is often done from remote vessels hauled separately onto the sites, for example forty-five gallon drums or wagons with fuel tanks on them, using flexible lines. The nature of the activity on sites where portable equipment is utilized, such as new construction areas, is such that fuel lines may be susceptible to damage.

The fuel conduction system includes the further benefit of enabling fuel consuming equipment with remote source of fuelling to become compliant as a unit or set with factory built equipment certification codes that have a requirement that should the fuel lines be ruptured the fuel in storage shall not escape from the storage vessel.

The concentric tube configuration provides protection against all reasonably foreseeable forms of fuel escape in the event of line damage in both siphoning and non-siphoning configurations of the pump and fuel supply. Non-siphoning configurations occur where the pump is located above the top of the fuel receptacle and is common with diesel fuelled equipment that incorporates integral fuel tanks. These tanks are generally slung under or are located very low on the equipment below the pump and therefore not vulnerable to siphoning. The tanks are however vulnerable to being pumped out should only the return line be damaged. With the return line of the concentric tube configuration being protected within the supply line a tank, a non-siphoning configuration is thus prevented from being pumped out. The concentric tube configuration thus provides a reasonable means of achieving compliance with all known requirements for diesel fuelled equipment which always employs two line systems having a supply line and a return line in both integral and remote fuelling configurations.

While one embodiment of the present invention has been described in the foregoing, it is to be understood that other embodiments are possible within the scope of the invention. For instance, it is to be recognised that the return line need not be exactly concentric with supply line, but need only extend longitudinally therethough within the boundaries of the supply line as is intended to be defined by the phrase substantially concentrically. The invention is to be considered limited solely by the scope of the appended claims.

What is claimed is:

1. A fuel conduction system for conducting fuel between a fuel source and a pump having an inlet, a main outlet and a pressure regulation return outlet, the fuel conduction system comprising:

a supply line extending in a longitudinal direction from a pump connecting end arranged to be connected to the inlet of the pump to a source connecting end arranged to be connected to the fuel source; and a return line extending substantially concentrically through the supply line in the longitudinal direction of the supply line from a pump connecting end adjacent the pump connecting end of the supply line and arranged to be connected to the pressure regulation return outlet to a source connecting end adjacent the source connecting end of the supply line arranged to be connected to the fuel source.

2. The system according to claim 1 wherein there is provided a valve coupled in series with the supply line adjacent the source connecting end, the valve including a valve member which is biased towards a closed position, the valve member being arranged to be opened in response to a reduction in pressure in the supply line associated with activation of the pump.

3. The system according to claim 2 wherein the valve is arranged to extend upwardly from an inlet to an outlet, the valve member being weighted so as to be seated on the inlet in the closed position in response to a reduction in pressure in the supply line associated with siphoning action of the supply line while being arranged to be raised upwardly from the inlet in an open position in response to a reduction in pressure in the supply line associated with activation of the pump.

4. The system according to claim 2 wherein there is provided a tank fitting arranged to selectively mount the source connecting ends of the respective supply and return lines to the fuel storage container, the tank fitting including the valve mounted integrally thereon.

5. The system according to claim 2 wherein there is provided a flashback arrestor coupled in series with the return line adjacent the source connecting end thereof.

6. The system according to claim 2 wherein there is provided a vent coupled to the return line adjacent the source connecting end thereof, the vent being arranged to permit air to be drawn into the return line therethrough so as to prevent siphoning of fuel from the fuel source through the return line.

7. The system according to claim 6 wherein the vent comprises an air flow check valve being arranged to restrict passage of fuel from the return line through the check valve while permitting air to be drawn into the return line through the check valve.

8. The system according to claim 1 wherein there is provided an outlet line arranged to be coupled to the main outlet of the pump and an envelope surrounding the outlet line between respective ends thereof, the envelope being coupled in communication with the supply line so as to produce a reduction in pressure within the envelope surrounding the outlet line upon activation of the pump.

9. The system according to claim 8 wherein the envelope and the outlet line comprise respective elongate tube members with the outlet line extending substantially concentrically through the envelope.

10. The system according to claim 1 wherein there is provided a manual shut-off valve coupled in series with the supply line adjacent the source connecting end thereof.

11. The system according to claim 1 wherein there is provided:

a pump connector coupled to the respective pump connecting ends of the supply and return lines, the pump connector including a pump inlet line in communication with the pump connecting end of the supply line which is arranged to be selectively coupled to the inlet of the pump and a pump return outlet line in communication with the pump connecting end of the return line which is arranged to be selectively coupled to the pressure regulation return outlet of the pump; and a fuel source connector coupled to the respective source connecting ends of the supply and return lines, the fuel source connector including source outlet line in communication with the source connecting end of the supply line which is arranged to be selectively coupled to the fuel source and a source inlet line in communication with the source connecting end of the return line which is arranged to be selectively coupled to the fuel source.

12. A fuel conduction system in combination with a fuel consuming device, the system comprising;

a fuel source;

a pump having an inlet, a main outlet and a pressure regulation return outlet;

a supply line extending in a longitudinal direction from a source connecting end coupled to the fuel source to a pump connecting end coupled to the inlet of the pump;

a return line extending substantially concentrically through the supply line in the longitudinal direction of the supply line from a source connecting end coupled to the fuel source to a pump connecting end coupled to the pressure regulation return outlet of the pump; and an outlet line coupled between the main outlet of the pump and the fuel consuming device.

13. The system according to claim 12 wherein there is provided a valve coupled in series with the supply line adjacent the source connecting end, the valve including a valve member which is biased towards a closed position, the valve member being arranged to be opened in response to a reduction in pressure in the supply line associated with activation of the pump.

14. The combination according to claim 12 wherein the supply and return lines are selectively separable from both the fuel source and the pump so as to permit the fuel source to be readily disconnected from and connected to the pump.

15. The combination according to claim 12 wherein there is provided an envelope surrounding the outlet line between respective ends thereof, the envelope being coupled in communication with the pump inlet so as to produce a reduction in pressure within the envelope surrounding the outlet line upon activation of the pump.

16. The combination according to claim 12 wherein the fuel source comprises a portable fuel container which is supported for rolling movement across the ground.

17. The combination according to claim 16 wherein the fuel consuming device is arranged to be selectively supported on the fuel source so as to permit selective separation thereof.

18. The combination according to claim 12 wherein the pump is mounted integrally on the fuel consuming device.

19. A portable fuel source for supplying fuel to a fuel consuming device having a pump including an inlet, a main outlet and a pressure regulation return outlet, the portable fuel source comprising:

a fuel storage container supported for rolling movement across the ground;

a supply line arranged to be coupled between the container and the inlet of the pump;

a return line arranged to be coupled between the container and the pressure regulation return outlet of the pump; and a valve mounted integrally on the container and being arranged to be coupled in series with the supply line, the valve including a valve member which is biased towards a closed position, the valve member being arranged to be opened in response to a reduction in pressure in the supply line associated with activation of the pump.

20. The portable fuel source according to claim 19 wherein the return line extends substantially concentrically through the supply line between respective ends of the lines.

21. The portable fuel source according to claim 19 wherein there is provided a flashback arrestor mounted integrally on the container and being arranged to be coupled in series with the return line.

22. The portable fuel source according to claim 19 wherein there is provided a vent on the return line being arranged to permit air to be drawn into the return line therethrough so as to prevent siphoning of fuel from the fuel source through the return line.

23. The portable fuel source according to claim 19 wherein there is provided a fuel consuming device which is arranged to be selectively supported on the fuel storage container for rolling movement therewith across the ground.

* * * * *